United States Patent [19]

Tashiro et al.

[11] 4,060,750

[45] Nov. 29, 1977

[54] COMPACT MAGNETRON WITH SMALL AXIAL LENGTH AND SLOT ANTENNA OUTPUT ATTACHED THERETO

[75] Inventors: Norio Tashiro, Yokohama; Hirokazu Takahashi, Tokyo, both of Japan

[73] Assignee: Tokyo Shibaura Electric Co., Ltd., Kawasaki, Japan

[21] Appl. No.: 685,995

[22] Filed: May 13, 1976

[30] Foreign Application Priority Data

May 13, 1975 Japan ..... 50-55456

[51] Int. Cl.[2] ..... H01J 25/50

[52] U.S. Cl. ..... 315/39.51; 315/39.53; 315/39.75; 315/39.77

[58] Field of Search ..... 315/39.51, 39.53, 39.75, 315/39.77, 34

[56] References Cited

U.S. PATENT DOCUMENTS

| | | | |
|---|---|---|---|
| 3,104,305 | 9/1963 | Crapuchettes | 315/39.53 X |
| 3,479,556 | 11/1969 | Cook | 315/39.53 X |
| 3,924,196 | 12/1975 | Takahashi et al. | 315/39.53 |

*Primary Examiner*—Saxfield Chatmon, Jr.
*Attorney, Agent, or Firm*—Oblon, Fisher, Spivak, McClelland & Maier

[57] ABSTRACT

A magnetron having a hollow cylindrical anode having resonance cavities formed therein and a cathode arranged in the axial direction of the anode, wherein one open end of the hollow cylindrical anode is fitted hermetically with a conductor plate electrically connected to the anode; a slot antenna is provided on the conductor plate; one end of an output conductor, the other end of which is connected to the resonance cavities, extends to the feeding point of the slot antenna for obtaining a microwave output.

23 Claims, 23 Drawing Figures

COMPACT MAGNETRON WITH SMALL AXIAL LENGTH AND SLOT ANTENNA OUTPUT ATTACHED THERETO

BACKGROUND OF THE INVENTION

This invention relates to a magnetron and more particularly to a magnetron provided with an improved microwave output section or antenna.

A microwave oven is generally so designed that any other interior space than a heating chamber having a required volume can be reduced to a minimum to render the microwave oven compact as a whole. Further, it is desired that microwaves be emitted from a magnetron fitted to the microwave oven with a uniform intensity throughout the heating chamber. Therefore, it is customarily demanded that a magnetron used with a microwave oven be substantially compact and the microwave-radiating characteristic of the magnetron be conformable to the design requirements of a microwave oven. However, a conventional magnetron for a microwave oven had its output section formed of a monopole antenna, presenting difficulties in fully meeting the above-mentioned requistes. The monopole antenna linearly extended outward in the axial direction of the cylindrical anode of the magnetron, enlarging the magnetron as a whole by that extent. Where the magnetron oscillated microwaves with a frequency of about 2,450 MHz, the monopole antenna was chosen to have a length of about 3 cm. The magnetron had a hollow cylindrical body 4 cm high and 4.5 cm in diameter. Therefore, the above-mentioned length of the antenna was regarded as unduly large relative to the magnetron body. Microwaves were emitted from the monopole antenna of the magnetron in a direction substantially perpendicular to the axis of the antenna. If, therefore, the magnetron was placed in the upper part of the heating chamber of a microwave oven without any attachment, the aforesaid requirements could scarecely be satisfied. The magnetron had to be fitted to an attachment specially provided for the microwave oven to enable microwaves to be emitted from the monopole antenna with a uniform intensity throughout the microwave oven. However, provision of such attachment properly made the microwave oven large appreciably.

SUMMARY OF THE INVENTION

It is accordingly an object of this invention to provide a substantially compact magnetron for use with a microwave oven.

Another object of the invention is to provide a magnetron capable of emitting microwaves in conformity to the design requirements of the microwave oven.

According to an aspect of this invention there is provided a magnetron which comprises a hollow cylindrical anode having resonance cavities defined therein; a cathode disposed in the anode in the axial direction thereof; magnetic means for applying a magnetic field to the interior space of the anode; a conductor plate disposed at the end of the cylindrical anode to be electrically connected to the cylindrical anode; and a slot antenna for radiating microwaves generated in the resonance cavities.

BRIEF DESCRIPTION OF THE DRAWING

FIGS. 3A to 7A are fractional cross sectional views of a vane type magnetron according to other embodiments of the invention with permanent magnets and yoke taken off;

FIGS. 3B to 7B are bottom views of a vane type magnetron corresponding to the embodiments of FIGS. 3A to 7A;

DETAILED DESCRIPTION OF THE PREFERRED EMBODIMENTS

Figure 1A:
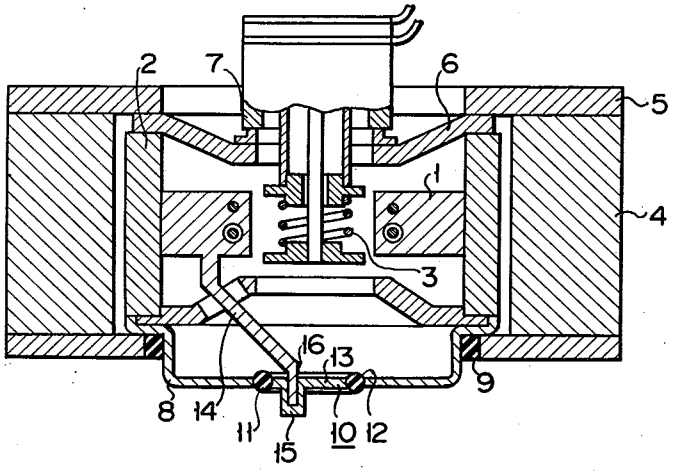
FIG. 1A is a fractional cross sectional view of a vane type magnetron according to an embodiment of this invention.
Figure 1B:
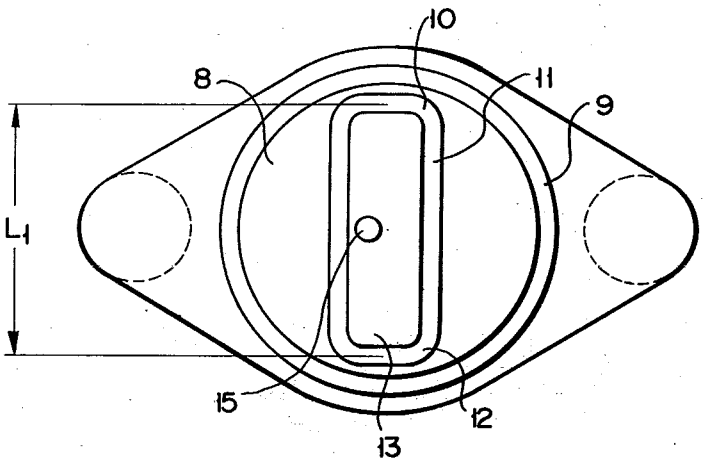
FIG. 1B is a bottom view of the vane type magnetron of FIG. 1A.

FIGS. 1A and 1B jointly represent a vane type magnetron according to a first embodiment of this invention. Referring to FIG. 1A, a plurality of vanes 1 are fitted to the inner wall of an anode cylinder 2. The vanes 1 and anode cylinder 2 constitute an anode. These plural vanes 1 radially project from the inner wall of the anode cylinder 2 toward the axis of said cylinder 2 in symmetrical relationship with respect to said axis. Resonance cavities are defined in the anode cylinder 2. A cathode 3 is disposed in the anode cylinder 2 to extend along its axis. Voltage is externally impressed across the cathode 3 and vanes 1. A pair of columnar permanent magnets 4 are set about the peripheral wall of the anode cylinder 2. A yoke 5 and magnetic pole pieces 6 are so arranged as to create a magnetic field in the axial direction of the anode cylinder, namely, in a direction perpendicular to the direction of an electric field. As the result, a field by oscillating current appears in perpendicular to the axis of the anode cylinder 2 in the resonance cavities.

One open end of the anode cylinder 2 is sealed hermetically with the magnetic pole piece 6 and cover 7. The other open end is closed hermetically with a metal cap 8 electrically connected to the anode cylinder 2 and a gasket 9 interposed between the cap 8 and yoke 5 to keep the interior of the anode cylinder 2 in a vacuum state. Formed in the metal cap 8 is a folded slot antenna 10 constituting the output section of a magnetron according to the first embodiment. The slot antenna 10 is constructed by boring a rectangularly bent slot 11 (FIG. 1B) in the cap 8. A dielectric member, for example, a glass member 12 permeable to microwaves is received in the slot 11 so as to render the interior space of the anode cylinder 2 airtight, and also securely to support a metal plate 13 enclosed in the slot 11. The lateral edge of the rectangular slot 11 has a length $L_1$ expressed by the following equation:

$$L_1 = n\lambda/2\sqrt{\epsilon_r}$$

where:

$\lambda$ = wave length of microwaves oscillated by the magnetron $\epsilon_r$ = specific dielectric constant of a dielectric member received in the slot $n$ = integer Where the dielectric member 12 of glass has as small a specific dielectric constant $\epsilon_r$ as about 1, then the lateral edge of the slot 11 is chosen to have a length $L_1$ equal to an integral multiple of half or substantially half the prescribed wave length of microwaves oscillated by the magnetron. Where the glass dielectric member 12 has a large specific dielectric constant $\epsilon_r$, then the lateral edge of the slot 11 has its length $L_1$ set at a smaller value than an integral multiple of substantially half the wave length of microwaves oscillated by the magnetron, in inverse proportion to the square root of the specific dielectric constant $\epsilon_r$. One end of an output conductor 14 is connected to one of the vanes 1. The other end of the output conductor 14 is securely connected to the feeding point 15 of the slot antenna 10 formed on the rectangular metal plate 13 by inserting the other end into a recess 16 provided in the metal plate 13 and compressing the recess 16 by an external force to clamp the other end within the recess.

The feeding point 15 is slightly displaced from the center of the metal plate 13 toward that lateral edge of the vanes 1 to which the aforesaid one end of the output conductor 14 is attached in order to decrease the length of the output conductor.

With a magnetron according to the first embodiment of this invention, microwave energy generated in the resonance cavities of the anode cylinder 2 is extracted to the folded slot antenna 10 through the output conductor 14 connected to the vanes 1. The resultant oscillation of the slot 11 excited by the microwave energy thus extracted causes the microwaves to be radiated outward from the center of the slot 11 with a uniform intensity.

Unlike the monopole antenna used in the conventional magnetron, the folded slot antenna 10 of the present magnetron does not require any extra attachment for radiation of microwaves with a uniform intensity. Further, the folded slot antenna 10 having a small slot resistance attains the effective radiation of microwaves.

There will now be described by reference to FIGS. 2A and 2B a vane type magnetron according to the second embodiment of this invention. The parts of FIGS. 2A and 2B and the succeeding embodiments the same as those of FIGS. 1A and 1B are denoted by the same numerals.

Figure 2A:
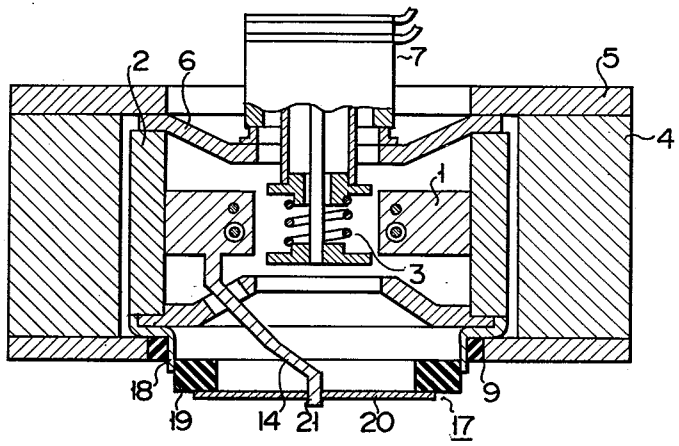
FIG. 2A is a fractional cross sectional view of a vane type magnetron according to another embodiment of the invention.
Figure 2B:
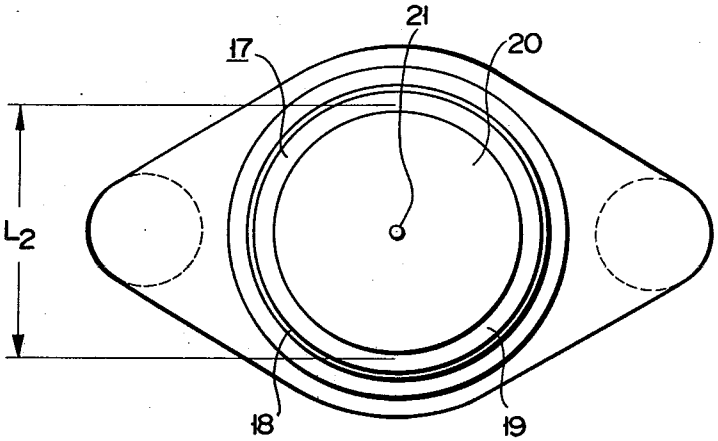
FIG. 2B is a bottom view of the vane type magnetron of FIG. 2A.

FIGS. 2A and 2B show a vane type magnetron having an annular slot antennal. This annular slot antenna 17 is formed by fitting an annular ceramic member 19 hermetically into a cylindrical frame 18 connected to the anode cylinder 2, and attaching a circular metal plate 20 to the opening of the annular ceramic member 10 also hermetically. Said annular slot antenna 17 is provided between the frame 18 connected to the anode cylinder 2 and circular metal plate 20, namely, on the outer periphery of the metal plate 20. The diameter D of the annular slot antenna 17 and the wave length $\lambda$ of microwaves oscillated by the magnetron have a relationship of $\pi L_2 = n\lambda/\sqrt{\epsilon_r}$ where:

$\epsilon_r$ = specific dielectric constant of a dielectric member received in a slot $\lambda$ = wave length of microwaves oscillated by the magnetron $n$ = integer Where the ceramic member 19 has a small specific dielectric constant $\epsilon_r$, then the entire length of the circular annular slot is defined to be equal to an integral multiple of a prescribed wavelength of microwaves oscillated by the magnetron or any other length approximating the prescribed wave length. Where the circular slot is demanded to have a small size, then the entire length of the slot is chosen to be equal to the prescribed wave length or any other length approximating the prescribed wave length. In other words, the diameter $L_2$ is chosen to be $1/\pi$ of the prescribed wave length of microwaves or approximately one third thereof. Where, however, the ceramic member 19 has a large specific dielectric constant $\epsilon_r$, then the diameter $L_2$ of the circular annular slot is chosen to be smaller than the abovementioned length in inverse proportion to the square root of the specific dielectric constant $\epsilon_r$. The metal frame 18 is supported hermetically by the gasket 9 positioned between the frame 18 and the yoke 5.

The feeding point 21 of microwaves produced in the resonance cavities is set substantially at the center of the circular metal plate 20. Connected to the feeding point 21 is one end of the output conductor 14, the other end of which is connected to one of the vanes 1. Accordingly, the circular annular slot antenna 17 is electrically oscillated when excited by microwaves extracted through the output conductor 14 connected to the resonance cavities, causing them to be emitted outward through the circular annular slot antenna 17 with a uniform intensity. Like the aforesaid folded slot antenna 10, the circular annular slot antenna 17 of the second embodiment eliminates the necessity of providing any extra attachment for radiation of microwaves with a uniform intensity. This circular annular slot antenna 17 has the advantage of being easily fabricated as apparent from its construction.

Figure 3A:
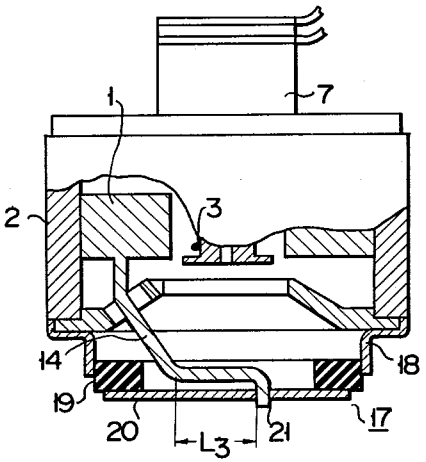
Figure 3B:
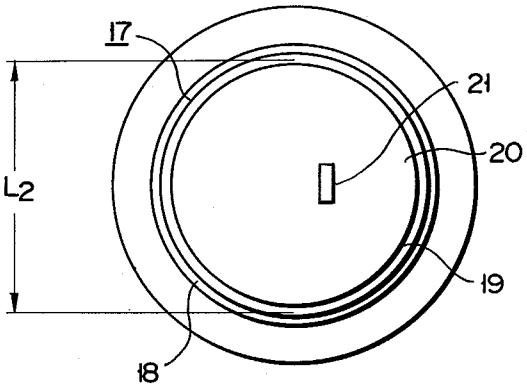

There will now be described by reference to FIGS. 3A and 3B the modification of FIGS. 2A and 2B. Like the second embodiment of FIGS. 2A and 2B, the magnetron of FIGS. 3A and 3B has a circular annular slot antenna 17, but is different from the second embodiment in that the output conductor 14 is improved. Namely, the output conductor 14 is so modified as to suppress at least one kind of higher harmonic wave included in microwaves oscillated by the magnetron. As seen from FIG. 3A, the output conductor 14 extending from the vane 1 is not connected linearly to the feeding point, but is bent at an intermediate point. The latter half section of the output conductor 14 is arranged parallel with the inner wall of the circular metal plate 20 with a small clearance. Finally, the outer end of the output conductor 14 is connected to the feeding point 21. Above mentioned latter half section of the output conductor 14 which is disposed parallel to the inner wall of the circular metal plate 20 has its length $L_3$ defined to be approximately a quarter of the length of a higher harmonic wave which is to be suppressed. The section and the circular metal plate 20 jointly constitute a choke for suppressing the higher harmonic wave. The modification of FIGS. 3A and 3B designed to suppress the higher harmonic wave can be operated under a stable condition.

Figure 4A:
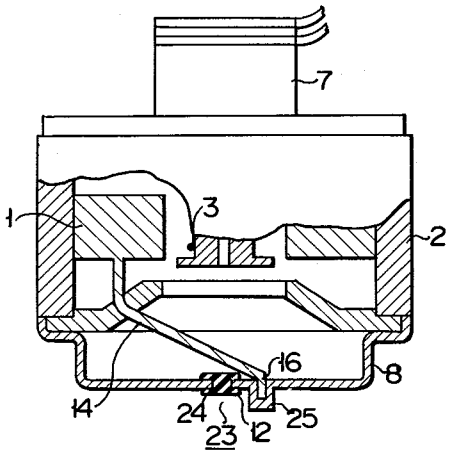
Figure 4B:
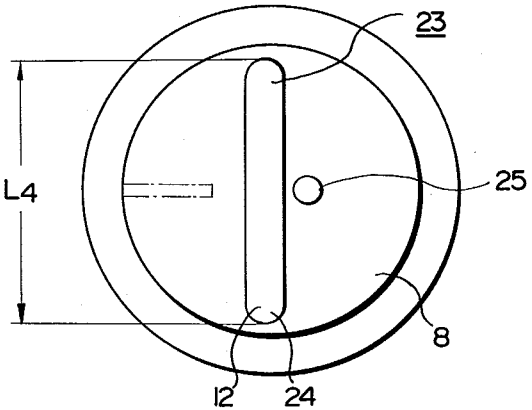

There will now be described by reference to FIGS. 4A and 4B a magnetron according to a third embodiment of this invention. FIGS. 4A and 4B set forth the main part of a magnetron provided with a rectangular slot antenna 23. The permanent magnets and yokes removed from the main part of the magnetron shown in FIGS. 4A and 4B for convenience of description are of the same type as those of FIGS. 1A and 2A. The rectangular slot antenna 23 is provided with a band-like slot 24 linearly extending along the diameter of the circular cap 8 closing one open end of the anode cylinder 2. The band-like slot 24 is hermetically closed with a dielectric member 12 made of, for example, glass to maintain vacuum in the interior space of the anode cylinder 2. A relationship between the longitudinal length $L_4$ of the band-like slot 24 and the wave length of microwaves is expressed by the following equation:

$$L_4 = n\lambda/2\sqrt{\epsilon_r}$$

where:

$\epsilon_r$ = specific dielectric constant of the dielectric member $\lambda$ = wave length of microwaves oscillated by the magnetron $n$ = integer Where the dielectric member 12 has as small a specific dielectric constant as 1, then the longitudinal length $L_4$ of the band-like slot 24 is defined to be an integral multiple of half or substantially half the prescribed length of microwaves generated in the resonance cavities of the anode cylinder 2. The metal cap 8 is directly connected to the anode cylinder 2. The metal cap 8 and anode cyliner 2 are electrically connected so as to provide a high frequency circuit across the slot antenna 23. One end of the output conductor 14 is connected to one of the vanes 1 to extract microwave energy from the resonance cavities of the anode cylinder 2.

The output conductor 14 extends to cross three dimensionally the central part of the band-like slot 24. The other end of the output conductor 14 is connected to the feeding point 25 disposed beside the slot 24. This feeding point 25 is so located as to provide a high frequency circuit across the slot 24. For convenience of description, FIG. 4B shows in a dot-dash line the projected cross sectional outline of a vane 1 which is connected to aforementioned one end of the output conductor 14. As apparent from FIG. 4B, the feeding point 25 is provided on the opposite side of the slot 24 to the projected cross sectional outline of the vane 1. Tight connection of the output conductor 14 to the feeding point 25 is effected by the same process as used in the first embodiment of FIGS. 1A and 1B, namely, by inserting the other end of the output conductor 14 into the recess 16 formed in the feeding point 25 of the circular metal cap 8 and compressing the recess 16 tightly to hold the other end of the output conductor within the recess 16.

Microwave energy created in the resonance cavities are extracted through the output conductor 14 to excite the rectangular slot antenna 23 with its resultant oscillation, causing microwaves to be emitted through the slot outside of the magnetron with a uniform intensity.

Figure 5A:
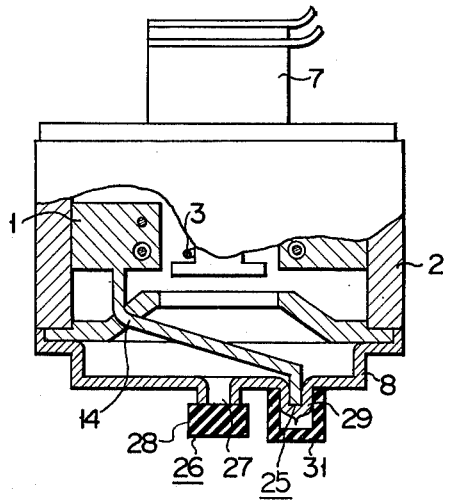
Figure 5B:
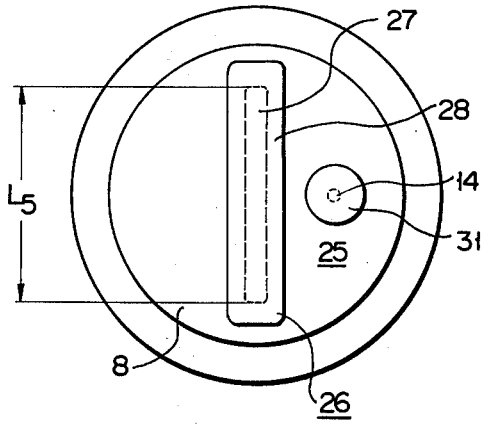

There will now be described by reference to FIGS. 5A and 5B a modification of the third embodiment of FIGS. 4A and 4B. The main part of the magnetron of FIGS. 5A and 5B is provided with a rectangular slot antenna 26 like the main part of the magnetron of FIGS. 4A and 4B. However, the rectangular slot antenna 26 of FIGS. 5A and 5B has a different form from the rectangular slot antenna 23 of FIGS. 4A and 4B.

The slot 27 illustrated in FIGS. 5A and 5B is not formed simply by cutting off a straight band-like portion from the central part of the circular metal cap 8. But the central part of said circular metal cap 8 is cut out in the straight band-like form. The cut flaps are bent to the outside of the cap 8 to provide a slot having a depth. In other words, the slot 27 of FIGS. 5A and 5B takes the same form as that which is obtained by fitting a frame to the periphery of the slot 24 of FIGS. 4A and 4B.

The opening 29 of the slot 27 defined by the bent portion of the metal cap 8 is closed hermetically with a dielectric ceramic member 28 having a specific dielectric constant $\epsilon_r$. When the specific dielectric constant $\epsilon_r$ has as small a value as 1, the longitudinal length $L_5$ of the slot 27 is chosen to be an integral multiple of half or substantially half the prescribed wave length of microwaves oscillated by the magnetron to establish the relationship of $L_5 = n\lambda/2\sqrt{\epsilon_r}$ (where $n$ is an integer; $\lambda$ is the wave length of magnetic waves oscillated by the magnetron; and $\epsilon_r$ is a specific dielectric constant). Where the dielectric ceramic member 28 has a large specific dielectric constant $\epsilon_r$, then the slot length $L_5$ is chosen to vary in inverse proportion to the square root of the specific dielectric constant $\epsilon_r$.

Figure 5C:
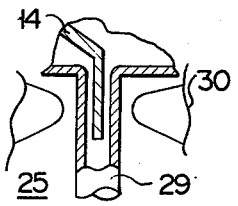
FIG. 5C is a fractional enlarged cross sectional view of an exhaust pipe used with a vane type magnetron from which a yoke and permanent magnets are removed as slown in FIGS. 5A and 5B, showing one of the steps of sealing said exhaust pipe.

Connection of the output conductor 14 to the feeding point 25 is carried out by inserting, as shown in FIG. 5C, the other end of the output conductor 14 into an exhaust pipe 29 formed at the feeding point 25 of the metal cap 8, evacuating air from an airtight envelope defined by the anode cylinder 2 and metal cap 8 and thereafter tipping off the exhaust pipe 29 by a cutter 30 (FIG. 5C) after thermal fusion of the end portion thereof. Since the exhaust pipe 29, together with the output conductor 14 is tipped off by the cutter 30 of FIG. 5C, said output conductor 14 is integrally fitted to the inner wall of the exhaust pipe 29 hermetically. The tipped off portion of the exhaust pipe 29 is covered with a cap 31 for protection.

A magnetron according to the above-mentioned modified embodiment is so constructed as easily to admit of application of a dielectric ceramic member 28 having a relatively large specific dielectric constant. Where, therefore, a dielectric member used has a large specific dielectric constant $\epsilon_r$, then the slot length of the resultant slot antenna can be decreased.

The slot antenna 26 is constructed by sealing the slot 27 with the dielectric member 28 hermetically from the outside of the metal cap 8. Therefore, the length of the outer peripheral surface of the dielectric member 28 (excluding that portion of the peripheral surface of the dielectric member 28 which faces the interior of the magnetron through the slot 27) becomes considerably large, prominently improving the voltage proof characteristic of the slot antenna 26.

Figure 6A:
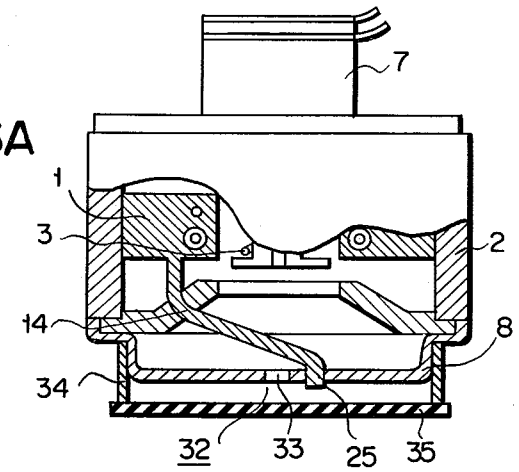
Figure 6B:
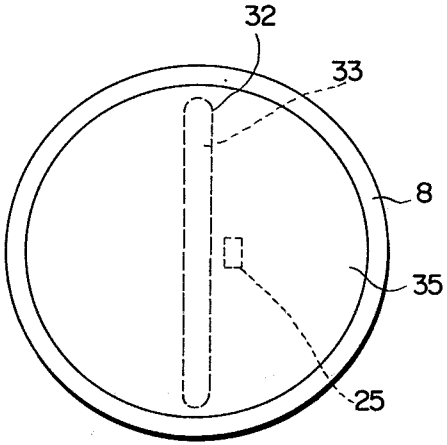

FIGS. 6A and 6B jointly set forth another modification of the magnetron of FIGS. 4A and 4B according to the third embodiment of this invention. The main part of the modified magnetron of FIGS. 6A and 6B comprises a rectangular slot antenna 32 like the main part of the magnetron of FIGS. 4A and 4B. However, the slot 33 of the rectangular slot antenna 32 of FIGS. 6A and 6B is not sealed with the dielectric member 28. A space in the anode cylinder 2 and a space outside of the metal cap 8 communicate each other through the slot 33.

A cylindrical frame 34 is fitted hermetically to the periphery of the metal cap 8. The opening of the cylindrical frame 34 is closed hermetically with a disk member 35 formed of dielectric material.

With the modified magnetron of FIGS. 6A and 6B, the slot 33 is not filled with a filler, but remains in vacuum, thereby elevating a break down voltage of high frequency. The spatial arrangement of the dielectric member 35 from the slot 33 offers the advantage of preventing the resonance point of the rectangular slot antenna 32 from being changed, even when the specific dielectric constant, shape or size of the dielectric disk member 35 somewhat varies.

Figure 7A:
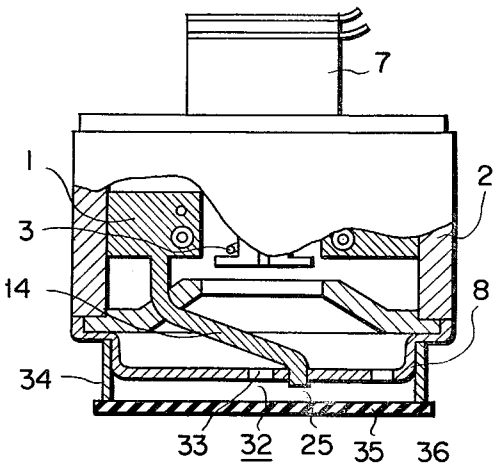
Figure 7B:
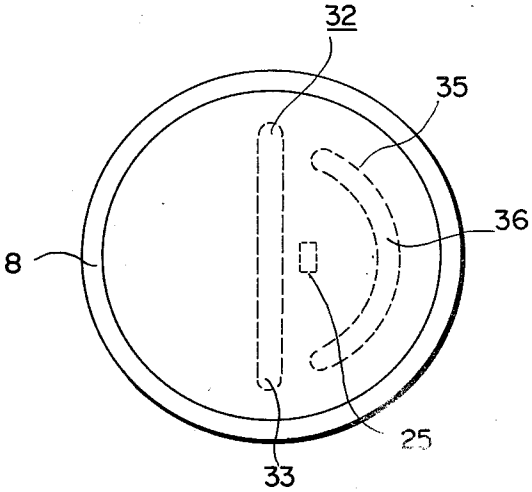

FIGS. 7A and 7B jointly present the main part of still another modification of the magnetron of FIGS. 4A and 4B according to the third embodiment of this invention. The main part of the modified magnetron of FIGS. 7A and 7B has substantially the same arrangement as that of FIGS. 6A and 6B, excepting that there is further provided means for causing a high frequency circuit to be always formed at right angles to the slot 32, namely, the metal cap 8 is provided with a semicircular decoupling slot 36. This decoupling slot 36 is so designed as to cause a high frequency circuit always to cross the slot antenna 32 at right angles, that is to prevent a high frequency circuit from detouring about the slot antenna 32, thereby enabling the magnetron to have an improved microwave-radiating property.

Figure 8:
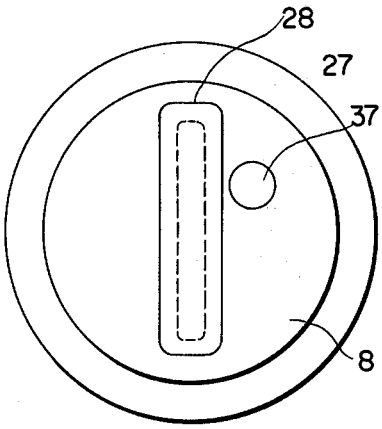
FIGS. 8 to 10 are bottom views of a vane type magnetron according to still another embodiments of the invention.

FIG. 8 illustrates the main part of a magnetron further modified from that of FIGS. 5A and 5B. According to the modification of FIG. 8, a microwave-feeding point 37 is provided alongside the lateral edge of the rectangular slot 27 bored along the central line of the metal cap 8 at a point displaced by a prescribed distance from the center of the rectangular slot 27 in order to attain an optimum matching between microwave energy generated in the resonance cavities and the resultant slot antenna by offset feed.

Figure 9:
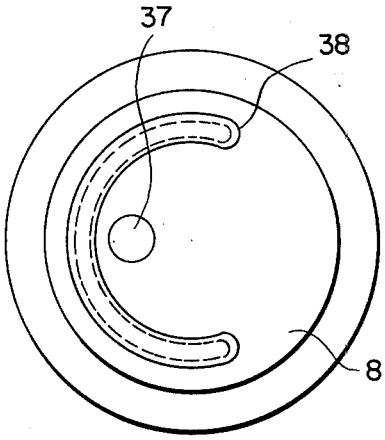

FIG. 9 shows a slot antenna 38 of a magnetron according to a further embodiment of this invention. With this embodiment, a semicircular annular slot antenna 38 is used in place of the rectangular slot antenna applied in the foregoing embodiments. The slot of said semicircular annular slot antenna 38 is chosen to have a length equal to an integral multiple of half or substantially half the prescribed wave length of microwaves oscillated by the magnetron. Namely, the embodiment of FIG. 9 provides a slot antenna capable of fully radiating microwaves having a desired wave length, even when the metal cap 8 is substantially small.

Figure 10:
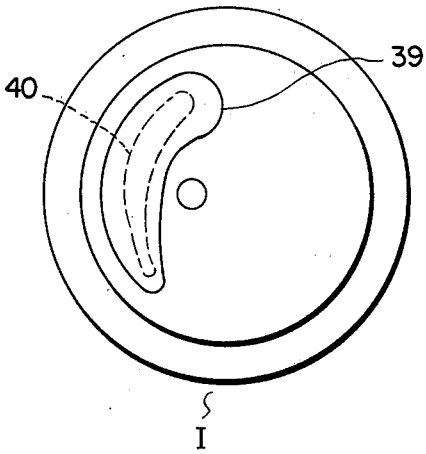
Figure 11:
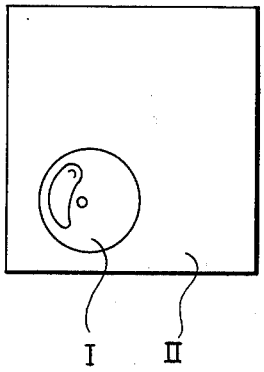
FIG. 11 schematically illustrates the manner in which the magnetron of FIG. 10 is fitted to the heating chamber of a microwave oven.

FIG. 10 indicates a slot antenna 39 of a magnetron according to a still further embodiment of this invention. A slot 40 of said slot antenna 39 is deformed into an unsymmetrical form. Referring to FIG. 11 the shape and size of the slot 40 is defined according to that spot in the heating chamber II of a microwave oven at which the output section or slot antenna 39 of the magnetron I is to be set. Since microwaves are radiated through the slot 40 by the magnetron I, microwaves emitted in a particular direction are prominently intensified by changing the shape of the slot 40. Therefore, the size of the slot 40 is defined according to the wave length of microwaves oscillated by the magnetron I, and the shape of the slot 40 is prescribed according to that place in the heating chamber II of the microwave oven at which the slot antenna 39 of the magnetron I is to be set in order to cause microwaves generated in said heating chamber II to have a uniform distribution of intensity. Where the magnetron I is positioned at a predetermined place in the heating chamber II as shown in FIG. 11, then microwaves produced in the heating chamber II have a uniform distribution of intensity, preventing an object exposed to emitted microwaves from, for example, being unevenly baked.

The foregoing description refers to the embodiments of a vane type magnetron. However, this invention is not limited to said type from the stand point of the object of the invention, but may be applicable in many other modifications such as the interdigital type, rising sun type or hole-slot type.

There will now be described by reference to FIGS. 12A, 12B, 13 and 14 the interdigital type of magnetron in particular.

Figure 12A:
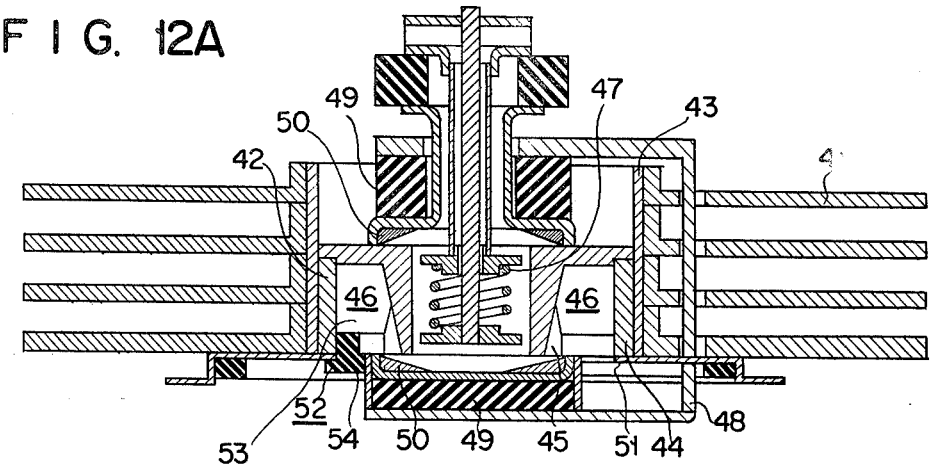
FIG. 12A is a cross sectional view of an interdigital type magnetron according to a further embodiment of the invention.
Figure 12B:
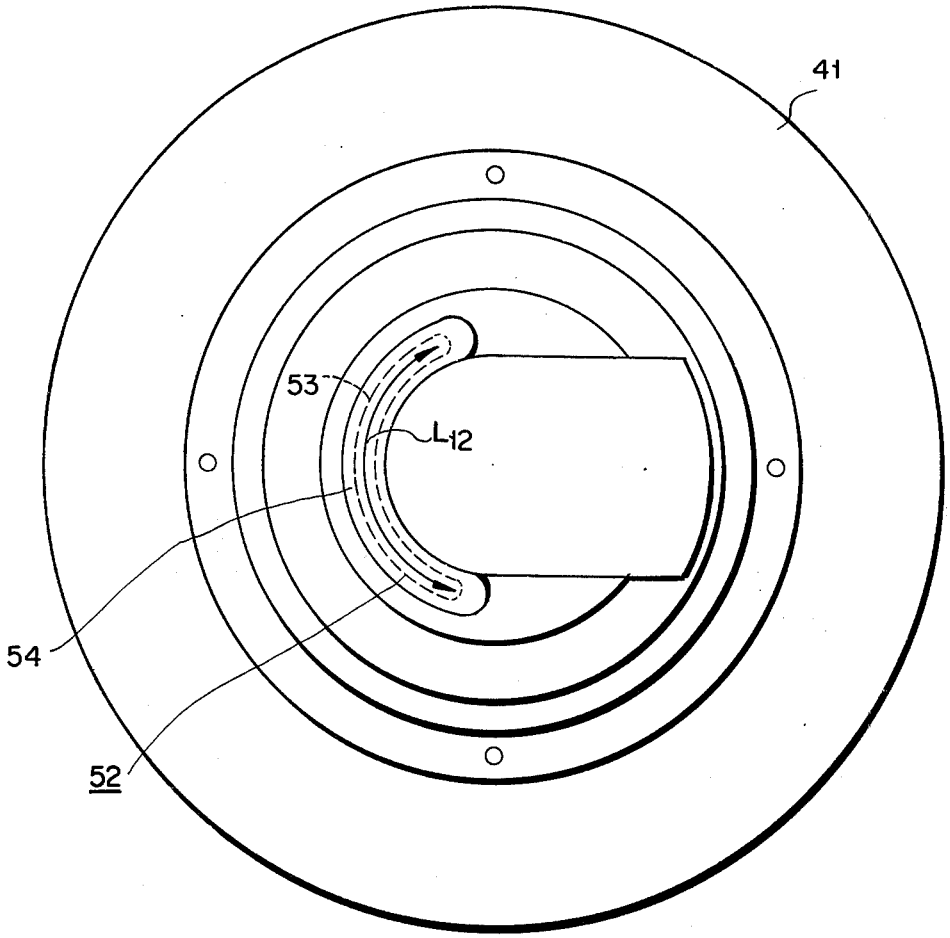
FIG. 12B is a bottom view of the interdigital type magnetron of FIG. 12A.

FIGS. 12A and 12B collectively present an interdigital type of magnetron provided with a radiator 41 for cooling the body of the magnetron. The radiator 41 is fitted to a support member 43 disposed on the periphery of an interdigital anode 42 having a substantially cylindrical form. The interdigital anode 42 is constructed, as shown in FIG. 12A, by vertically interdigitating a plurality of substantially L-shaped fingers 45 extending upward and downward from the cylindrical anode 44. Spaces defined by the plural fingers 45 constitute a resonance cavity 46.

A cathode 47 is disposed in the axial direction of the interdigital anode 42. A pair of permanent magnets 49 connected by a yoke 48 are respectively provided above and below the interdigital anode 42. The magnetic pole pieces 50 of the paired permanent magnets 49 are so arranged as to create a magnetic field in an interaction space intersecting an electric field at right angles between the cathode 47 and interdigital anode 42.

A metal cap 51 closing one open end of the cylindrical interdigital anode 42 is provided with a slot antenna 52 as shown in FIGS. 12A and 12B. The slot of said slot antenna 52 may take various forms as previously described. For example, the slot antenna 52 has its slot 53 shaped like a semicircular annular form as illustrated in FIG. 12B. The slot antenna 52 is constructed by boring a semicircular annular slot 53 in the metal gap 51 and closing the slot 53 hermetically with, for example, ceramic material.

A distance $L_{12}$ between both ends of the semicircular annular slot 53 (hereinafter referred to as a "sequential length") is expressed by the equation: $L_{12} = n\lambda/2\sqrt{\epsilon_r}$ (where $n$ is an integer; $\lambda$ is the wave length of microwaves oscillated by the interdigital type magnetron; and $\epsilon_r$ is the specific dielectric constant of dielectric material). Where the specific dielectric constant $\epsilon_r$ is as small as about 1, then the "sequential length" $L_{12}$ of the semicircular annular slot 53 is chosen to be an integral multiple of half or substantially half the prescribed wave length of microwaves oscillated by the interdigital type magnetron. Where the dielectric member has a large dielectric constant $\epsilon_r$, then the sequential length $L_{12}$ of the semicircular annular slot 53 becomes inversely proportional to the square root of said dielectric constant $\epsilon_r$ to have a smaller value than in the preceding case.

Figure 13:
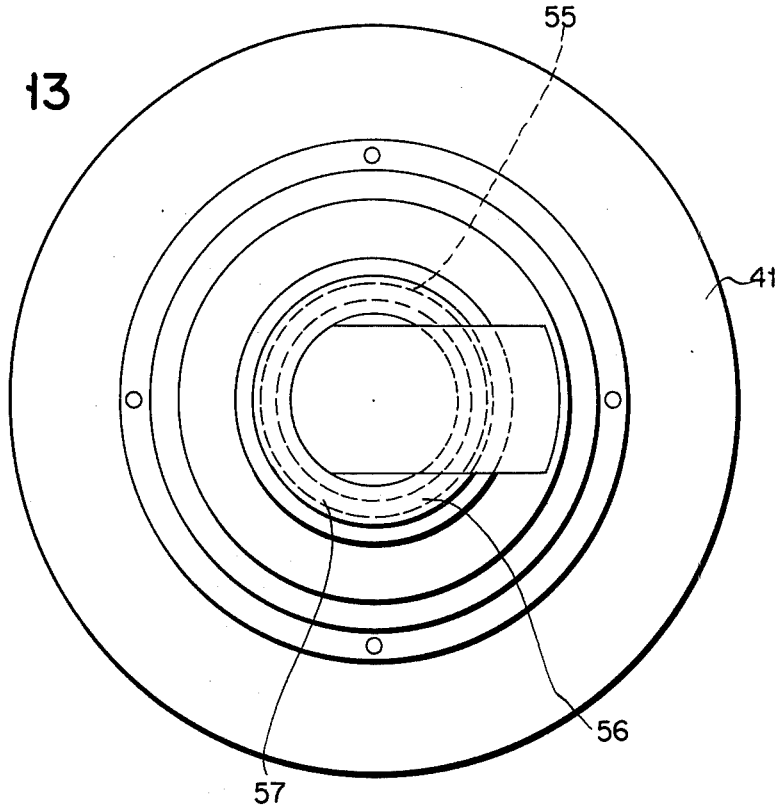
FIGS. 13, and 14 are bottom views of an interdigital type magnetron according to still further embodiments of the invention.
Figure 14:
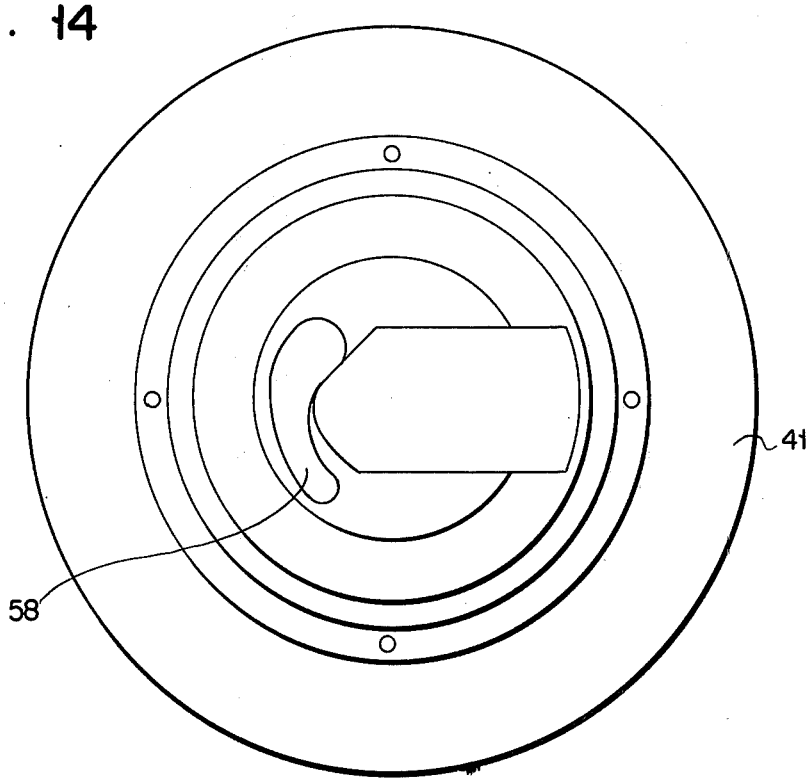

FIGS. 13 and 14 show the bottom of the interdigital type magnetron. It will be noted from these figures that as in the vane type magnetron, the slot of the slot antenna of the interdigital type magnetron need not be restrictively chosen to have a semicircular annular form.

FIG. 13 illustrates a fully circular annular slot antenna 56 provided with a fully circular annular slot 55. A dielectric disk member 57 is inserted hermetically into the fully circular annular slot 55. The radius $L_{13}$ of the fully circular annular slot 75 is expressed by the equation: $L_{13} = (n\lambda)/\pi\sqrt{\epsilon_r}$) (where $n$ is an integer; $\lambda$ is the wave length of microwaves oscillated by the interdigital magnetron; and $\epsilon_r$ is the specific dielectric constant of the dielectric disk member 57 fitted into the fully circular annular slot 55). Where the dielectric member 57 has such a small dielectric constant as approximately 1, then the circumferential length $2\pi L_{13}$ of the fully circular annular slot 55 is chosen to have a value equal to an integral multiple of a prescribed wave length of microwaves oscillated by the interdigial magnetron or any other value approximating an integral multiple of said prescribed wave length. Where the dielectric material 57 has a large specific dielectric constant, then the circumferential length $2\pi L_{13}$ of the fully circular annular slot 55 is set at a smaller value than in the preceding case. The above-mentioned relations associated with the interdigital type magnetron are the same as those of the vane type.

FIG. 14 shows a further modified slot antenna 58, where the shape and size of the slot thereof are defined according to that spot in the oven II of a microwave oven at which the magnetron I is to be placed.

Obviously, an interdigital type magnetron using the above-mentioned various forms of slot antenna produces the same effect as the vane type magnetron.

Unlike the vane type magnetron, the interdigital magnetron is characterized in that since resonance electric field occurring in the resonance cavity 46 acts in a direction substantially parallel with the axis of the cylindrical anode 44, the metal cap 51 has only to be provided with the slot antenna 52 eliminating the necessity of providing an output conductor for extracting microwave energy.

The interdigital type magnetron of this invention fitted with a slot antenna has the following advantages:

1. Since the cap 51 of the cylindrical anode 44 itself is made of metal, it is unnecessary to provide a separate metal cap or frame as is the case with the vane type magnetron, making it easy to manufacture a slot antenna;

2. Like the vane type magnetron, the interdigital type magnetron of FIG. 12A is characterized in that the radiator can be fitted more easily than when a slot is provided on the cylindrical anode side of a magnetron, enabling the magnetron to be easily meanfuctured; and 3. A slot antenna is mounted on the cap 51 of the cylindrical anode 44 and microwaves are emitted in the axial direction of the interdigital type magnetron of this invention, rendering said magnetron (as well as the vane type thereof) well adapted for use with a microwave oven.

Following are further advantages of this invention:

1. The magnetron of this invention can be miniaturized, and when used with a microwave oven, render the other parts of the microwave oven than the heating chamber considerably compact;

2. The microwave-emitting characteristic of the subject magnetron favorably meets the design requirements of the microwave oven, attaining the ideal distribution of microwaves generated in the heating chamber of the microwave oven without fitting any attachment; and 3. The subject magnetron having a very simple arrangement can be easily manufactured in the form capable of being operated under a stable condition.

What we claim is:

1. A vane-type magnetron comprising:

an anode having an anode cylinder and a plurality of vanes extending from the inner surface of the anode cylinder toward the central axis of the anode cylinder to define resonance cavities within the anode cylinder, a cathode disposed at the central axis of the anode cylinder, magnetic means for applying a magnetic field to a space between the anode and the cathode, a conductor member disposed at one end opening of the anode for electrical connection therewith, a slot antenna comprising a bored slot in the conductor member for radiating microwaves generated in the resonance cavities, a microwave-output conductor, one end of which is electrically connected to a vane and the other end of which is connected to a microwave-feeding point of the slot antenna, and sealing means for maintaining the internal space of the anode hermetic.

2. the magnetron according to claim 1, wherein the anode has a cylindrical form; and the conductor member has a plate form.

3. The magnetron according to claim 1, wherein the slot antenna is a folded type constructed by boring a rectangular slot in the conductor member; the sealing means comprises a dielectric member fitted into the slot hermetically; the rectangular slot is chosen to have a lateral length L expressed by the formula: $L = n\lambda/2\sqrt{\epsilon_r}$ (where $n$ is an integer; $\lambda$ is the wave length of microwaves oscillated by the magnetron; and $\epsilon_r$ is the specific dielectric constant of the dielectric member inserted into the slot).

4. The magnetron according to claim 3, wherein the folded slot antenna has a microwave-feeding point positioned substantially at the center of a rectangular dielectric member surrounded by the slot of said folded slot antenna.

5. The magnetron having the output conductor described in claim 1, wherein the slot antenna is an annular type constructed by boring a circular annular slot in the diconductor member; the sealing means comprises the dielectric member inserted into the circular annular slot hermetically; and the radius L of the circular annular slot is expressed by the equation: $L = n\lambda/\pi\sqrt{\epsilon_r}$ (where $n$ is an integer; $\lambda$ is the wave length of microwaves oscillated by the magnetron; and $\epsilon_r$ is the specific dielectric constant of the dielectric member inserted into the circular slot).

6. The magnetron according to claim 5, wherein the annular slot antenna has a microwave-feeding point positioned substantially at the center of the circular conductor member surrounded by the slot of the annular slot antenna.

7. The magnetron according to claim 5, wherein the output conductor comprises a linear portion disposed in close proximity to and parallel with the circular conductor member surrounded by the slot of the annular slot antenna with a small gap allowed between said linear portion and conductor member; and the length of the linear portion is chosen to be substantially a quarter of the wave length of these of the higher harmonics included in the microwaves oscillated by the magnetron which should be suppressed.

8. The magnetron according to claim 1, wherein the slot antenna is a rectangular type constructed by boring a linear band-like slot in the conductor member; and the length of said band-like slot is defined to be an integral multiple of half or substantially half the prescribed wave length of microwaves oscillated by the magnetron.

9. The magnetron according to claim 8, wherein the rectangular slot antenna has a microwave-feeding point located on the conductor member disposed close to the substantially central part of the linear slot; and the output conductor has one end electrically connected to the resonance cavities and the other end connected to the microwave-feeding point to intersect the linear band-like slot three-dimensionally.

10. The magnetron according to claim 8, wherein the rectangular slot antenna has a microwave-feeding point provided on the conductor member at a point slightly displaced from substantially the central part of the linear slot; and the output conductor has one end electrically connected to the resonance cavities and the other end connected to the microwave-feeding point to intersect the linear band-like slot three-dimensionally.

11. The magnetron according to claim 8, wherein the sealing means includes a dielectric member inserted hermetically into the slot of the rectangular slot antenna; and the length L of the rectangular slot is expressed by the equation: $L = n\lambda/2\sqrt{\epsilon_r}$ (where $n$ is an integer; $\lambda$ is the wave length of microwaves oscillated by the magnetron; and $\epsilon_r$ is the specific dielectric constant of the dielectric member inserted into the rectangular slot).

12. The magnetron according to claim 8, wherein the sealing means comprises a cover formed of a dielectric member enwrapping the conductor member hermetically.

13. The magnetron according to claim 8, which comprises a decoupling slot formed of an auxiliary slot bored in the plate-like conductor in parallel with the slot of the rectangular slot antenna; and wherein the rectangular slot has a microwave feeding point to which the output conductor is connected so as to three-dimensionally intersect the rectangular slot antenna, but not the auxiliary decoupling slot antenna.

14. The magnetron according to claim 13, wherein the rectangular slot and the decoupling slot are filled with a dielectric member hermetically.

15. The magnetron according to claim 13, wherein the conductor member is surrounded with covering means made of dielectric material.

16. The magnetron according to claim 1, wherein the slot antenna is provided with a semicircular annular slot whose length is defined to have a value equal to an integral multiple of half or substantially half the prescribed wave length of microwaves oscillated by the magnetron.

17. The magnetron according to claim 16, wherein the sealing means includes a dielectric member inserted into the slot hermetically; and the length L of the semicircular annular slot is expressed by the equation: $L = n\lambda/2\sqrt{\epsilon_r}$ (where $n$ is an integer; $\lambda$ is the wave length of microwaves oscillated by the magnetron; and $\epsilon_r$ is the specific dielectric constant of the dielectric member inserted into the slot).

18. The magnetron according to claim 1, wherein the slot antenna is provided with a modified slot whose shape and size are varied according to that spot in a microwave oven at which the magnetron is to be set.

19. An interdigital type magnetron, which comprises an anode having resonance cavities provided therein; a cathode disposed in the axial direction of the anode; magnetic means for applying a magnetic field to a space defined between the anode and the cathode; a conductor member closing one end opening of the anode; a slot antenna for radiating microwaves generated in the resonance cavities through a slot bored in said conductor member; and sealing means for keeping the internal space of the anode hermetically.

20. The interdigital type magnetron according to claim 19, wherein the anode has a cylindrical form; and the conductor member has a plate form.

21. The interdigital type magnetron according to claim 19, wherein the slot antenna is an annular type constructed by boring a circular annular slot in the plate-like conductor member; the sealing means includes a dielectric member inserted into the slot hermetically; and the radius L of the circular annular slot is expressed by the equation: $L = n\lambda/\pi\sqrt{\epsilon_r}$ (where $n$ is an integer; $\lambda$ is the wave length of microwaves oscillated by the magnetron; and $\epsilon_r$ is the specific dielectric constant of the dielectric member inserted into the slot).

22. The interdigital type magnetron according to claim 19, wherein the slot antenna is a semicircular type constructed by boring a semicircular annular slot in a plate-like conductor member, the sealing means includes a dielectric member inserted into the slot hermetically; and the length L of the semicircular annular slot is expressed by the equation: $L = n\lambda/2\sqrt{\epsilon_r}$ (where $n$ is an integer; $\lambda$ is the wave length of microwaves oscillated by the magnetron; and $\epsilon_r$ is the specific dielectric constant of the dielectric member inserted into the semicircular annular slot.

23. The interdigital magnetron according to claim 19, wherein the slot antenna is a modified type whose shape and size are varied according to that spot in the microwave oven at which said magnetron is to be disposed.

* * * * *